US005755565A

United States Patent [19]

Koyama et al.

[11] Patent Number: 5,755,565

[45] Date of Patent: May 26, 1998

[54] ROTARY PUMP HAVING REINFORCING WALL IN A PASSAGE

[75] Inventors: Takao Koyama, Atsugi; Masaki Simakura, Zama, both of Japan

[73] Assignee: Nissan Motor Co., Ltd, Yokohama, Japan

[21] Appl. No.: 891,412

[22] Filed: Jul. 9, 1997

Related U.S. Application Data

[63] Continuation of Ser. No. 592,173, Jan. 26, 1996, abandoned.

[30] Foreign Application Priority Data

Jan. 31, 1995 [JP] Japan ..... 7-13857

[51] Int. Cl.[6] ..... F04C 2/10; F04C 15/00

[52] U.S. Cl. ..... 418/170; 418/270

[58] Field of Search ..... 418/15, 166, 170, 418/171, 259, 270

[56] References Cited

U.S. PATENT DOCUMENTS

| | | | |
|---|---|---|---|
| 2,339,966 | 1/1944 | Ungar | 418/171 |
| 2,872,872 | 2/1959 | Quintilin | 418/171 |
| 3,096,720 | 7/1963 | Younger | 418/170 |
| 5,299,923 | 4/1994 | Arbogast et al. | 418/171 |
| 5,431,552 | 7/1995 | Schuller et al. | 418/15 |

FOREIGN PATENT DOCUMENTS

| | | | |
|---|---|---|---|
| 676722 | 12/1963 | Canada | 418/171 |
| 27764 | 5/1924 | France | 418/15 |
| 1010696 | 11/1965 | United Kingdom | 418/171 |

OTHER PUBLICATIONS

"Maintenance Manual for Electorically Controlled Automaic Trans-axle RL4FO3A" Nissan Motor Co., Ltd., (1989).

*Primary Examiner*—John J. Vrablik
*Attorney, Agent, or Firm*—Foley & Lardner

[57] ABSTRACT

A pump has inner and outer gears, suction and discharge passages, and a reinforcing member arranged in at least one of openings of the suction and discharge passages, the reinforcing member reinforcing a wall between the at least one opening and an inner peripheral surface of a gear pocket formed in a housing.

3 Claims, 5 Drawing Sheets

ROTARY PUMP HAVING REINFORCING WALL IN A PASSAGE

This application is a continuation of application Ser. No. 08/592,173, filed Jan. 26, 1996, now abandoned.

BACKGROUND OF THE INVENTION

The present invention relates to a pump for an automatic transmission, which serves to suck and discharge operating fluid for shift control of the automatic transmission and lubrication of a power transmission.

In the automatic transmission, a transmission path or gear position is determined by selective hydraulic operation of friction elements such as a clutch and a brake through a shift control fluid pressure circuit. Accordingly, the automatic transmission needs a pump for sucking and discharging operating fluid. This pump also serves to supply lubricating fluid to the power transmission, and working fluid to a torque converter.

A conventionally proposed pump for an automatic transmission is shown, for example, in a Maintenance Manual for Electorically Controlled Automatic Trans-axle RL4F03A published by Nissan Motor Co. Ltd., in May, 1989.

This known pump comprises a housing formed with a gear pocket. Engaged with an inner peripheral surface of the gear pocket is an outer gear having internal teeth with which an inner gear is meshed. A crescent is arranged in the gear pocket to fill a clearance between the outer and inner gears. Moreover, the pump housing has a suction port in an increased volume area of a pump chamber formed between the teeth of the outer and inner gears and a discharge port in a decreased volume area of the pump chamber, and a suction passage and a discharge passage to communicate with the suction and discharge ports.

As for operation of the pump, when the inner gear is driven and rotated to accompany the outer gear, operating fluid is sucked from the suction port via an opening of the suction passage, then discharged from the discharge port via an opening of the discharge passage.

However, such known pump for an automatic transmission has a problem of seizing since the outer and inner gears produce slide movement in the gear pocket. Thus, a high dimensional accuracy is required for machining of component parts of the pump. A dimensional accuracy of the gear pocket to which the outer and inner gears are mounted is important in particular, and is determined, with regard to seizing, for example, in a wide allowable range of the pressure of tens kg/cm$^2$ maximum at 6,000 rpm. Moreover, since, in order to ensure a high volume efficiency in the gear pocket, a clearance between an outer periphery of the outer gear and an inner periphery of the gear pocket is determined at some dozen μm, both should be machined to have the circularity of some dozen μm.

Due to restriction of an external dimension, the pump housing tends to have a reduced wall between the inner peripheral surface of the gear pocket and the opening of the discharge passage. This results in inevitable occurrence of spring back at the wall when machining the inner peripheral surface of the gear pocket, deteriorating the circularity thereof, and thus meeting insufficiently the requirements of the above accuracy. A reduction in a sectional area of the openings of the suction and discharge passages can be adopted as countermeasures against spring back. In that case, a difference in an opening area is increased between the suction and discharge passages and the suction and discharge ports, respectively, resulting in another problem of occurrence of cavitation noise on the side of the suction passage, and an excessive increase in the discharge pressure on the side of the discharge passage.

It is, therefore, an object of the present invention to provide a pump for an automatic transmission that enables reinforcement of the wall between the inner peripheral surface of the gear pocket and the opening of the discharge passage without reducing an opening area of the suction and discharge passages.

SUMMARY OF THE INVENTION

According to one aspect of the present invention, there is provided a pump, comprising:

a housing;

pump elements arranged in said housing, said pump elements serving to vary a volume of a pump chamber with rotation;

means for defining a suction passage, said suction passage defining means communicating with a suction port formed in an increased volume area of said pump chamber, said suction passage defining means having an opening;

means for defining a discharge passage, said discharge passage defining means communicating with a discharge port formed in a decreased volume area of said pump chamber, said discharge passage defining means having an opening; and a reinforcing member arranged in at least one of said opening of said suction passage defining means and said opening of said discharge passage defining means, said reinforcing member reinforcing a wall between said at least one opening and an inner peripheral surface of a cavity for said pump elements formed in said housing.

Another aspect of the present invention lies in providing a pump, comprising:

a housing;

pump elements arranged in said housing, said pump elements serving to vary a volume of a pump chamber with rotation;

means for defining a suction passage, said suction passage defining means communicating with a suction port formed in an increased volume area of said pump chamber, said suction passage defining means having an opening;

means for defining a discharge passage, said discharge passage defining means communicating with a discharge port formed in a decreased volume area of said pump chamber, said discharge passage defining means having an opening; and means, arranged in at least one of said opening of said suction passage defining means and said opening of said discharge passage defining means, for reinforcing a wall between said at least one opening and an inner peripheral surface of a cavity for said pump elements formed in said housing.

DETAILED DESCRIPTION OF THE INVENTION

Figure 1:
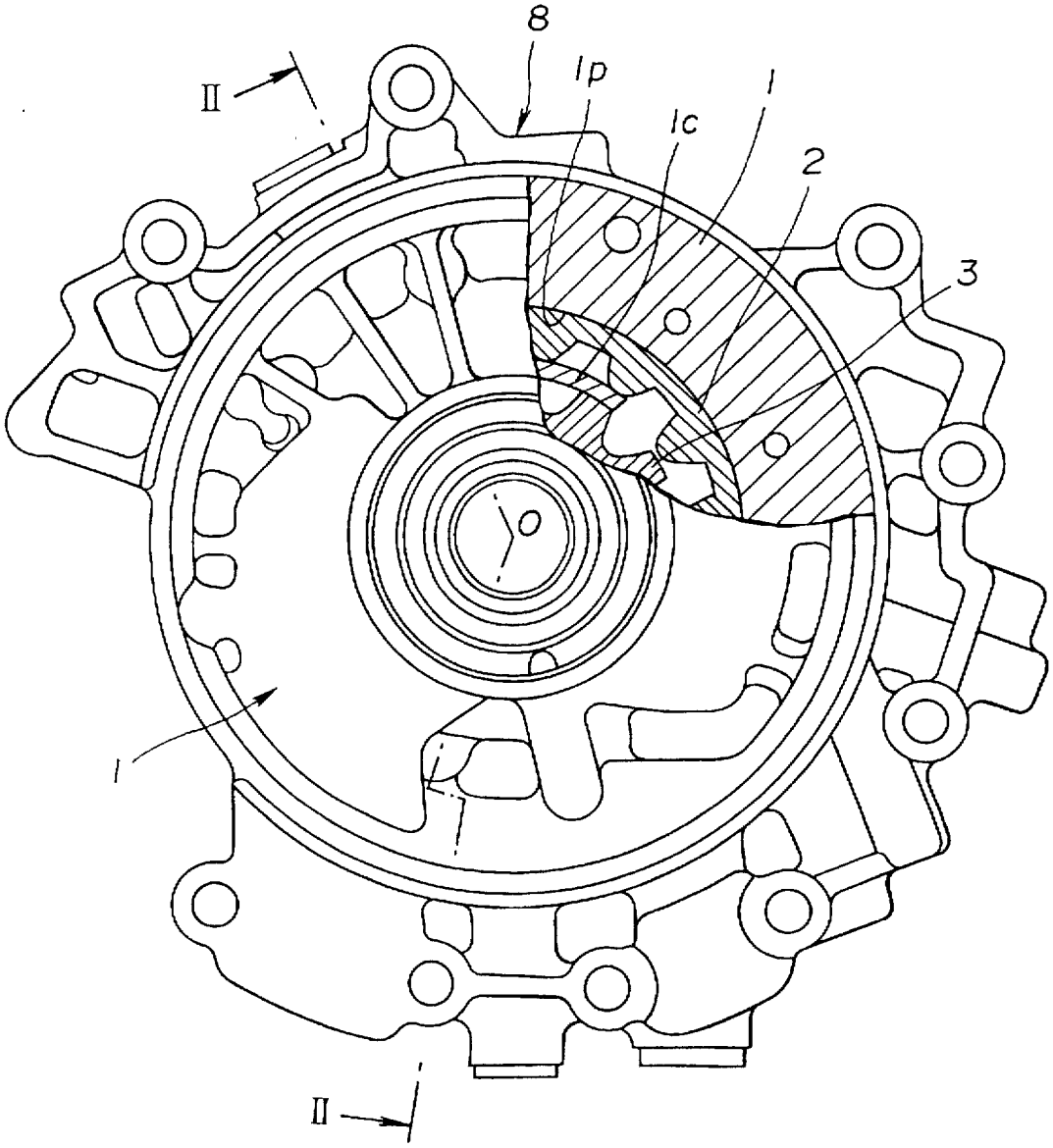
FIG. 1 is a plan view, partly broken, showing a preferred embodiment of a pump for an automatic transmission according to the present invention.

Referring to the drawings, a preferred embodiment of the present invention will be described in detail.

Figure 2:
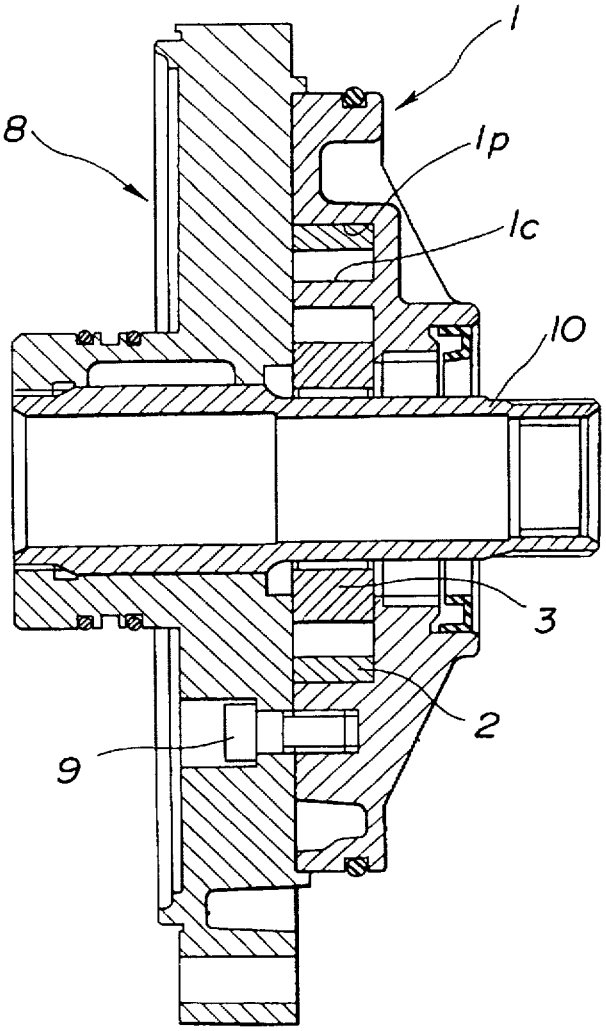
FIG. 2 is a sectional view taken along the line II-O-II in FIG. 1.

Referring first to FIGS. 1 and 2, a pump comprises a housing, generally designated by a reference numeral 1, formed with a gear pocket 1*p*. Engaged with an inner peripheral surface of the gear pocket 1*p* is an outer gear 2 having internal teeth with which an inner gear 3 is meshed. A crescent 1*c* is arranged in the gear pocket 1*p* to fill a clearance between the outer and inner gears 2, 3. Referring to FIG. 2, the pump housing 1 is coupled with a pump cover 8 by bolts 9, and the inner gear 3 is engaged with a dry sleeve 10 which, operates together with a torque converter (not shown), and is rotated with the outer gear 2 meshed with the inner gear 3.

Figure 3:
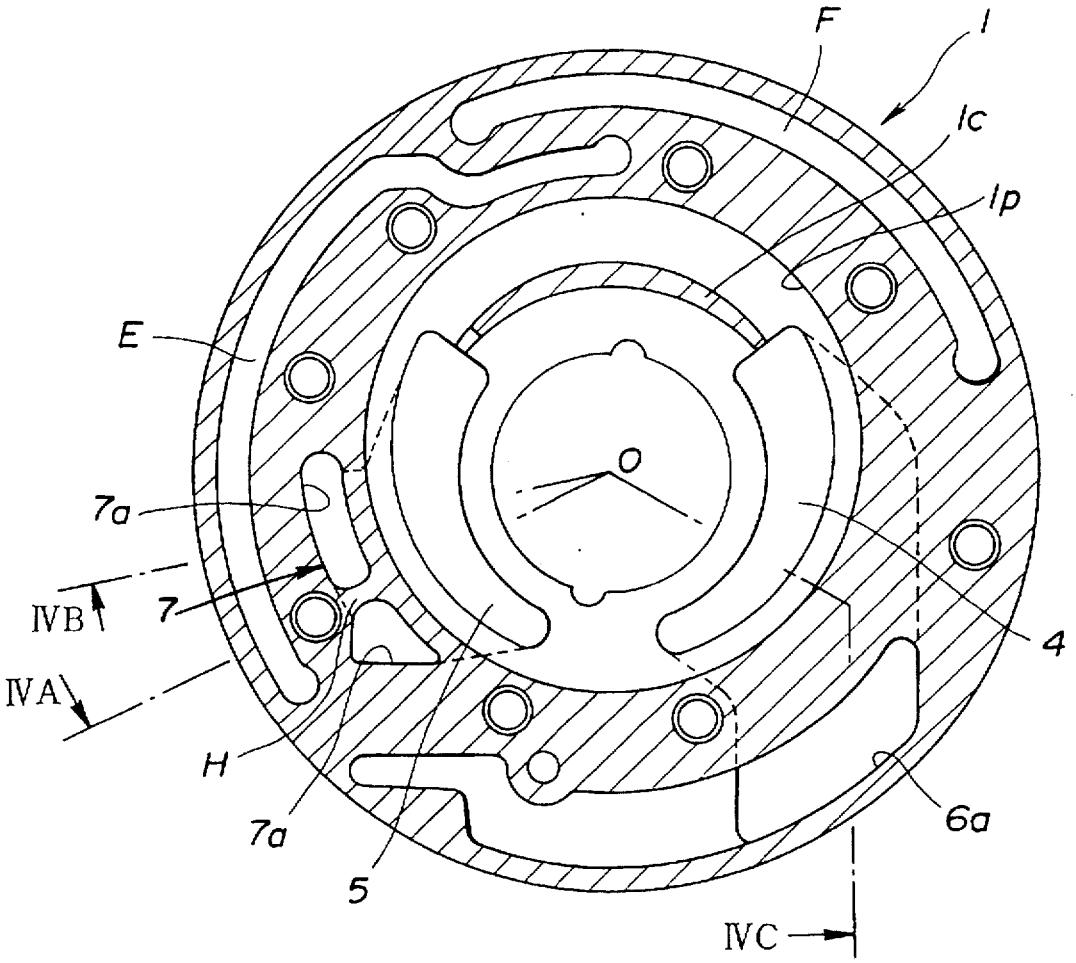
FIG. 3 is a view similar to FIG. 1, showing a pump housing as viewed from a mating face with a pump cover.

Referring to FIG. 3, assuming that the outer gear 2 and the inner gear 3 are rotated counterclockwise as viewed in FIG. 3, a reinforcing member H is arranged only in an opening 7*a* of a discharge passage 7 to connect an edge near the inner peripheral surface of the gear pocket 1*p* and an edge distant therefrom. Moreover, a suction port 4 is formed in a right area of a pump chamber formed between teeth of the outer and inner gears 2, 3 of the gear pocket 1*p*, which increases a volume upon rotation, whereas a discharge port 5 is formed in a left area of the pump chamber, which decreases a volume upon rotation. Hydraulic passages E, F have a difference in level with respect to a mating face of the pump housing 1 with the pump cover 8, and form the other hydraulic circuit.

Figure 4A:
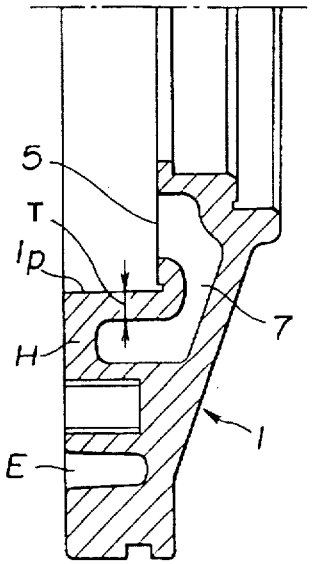
FIG. 4A is a view similar to FIG. 2, taken along the line O-IVA in FIG. 3.
Figure 4B:
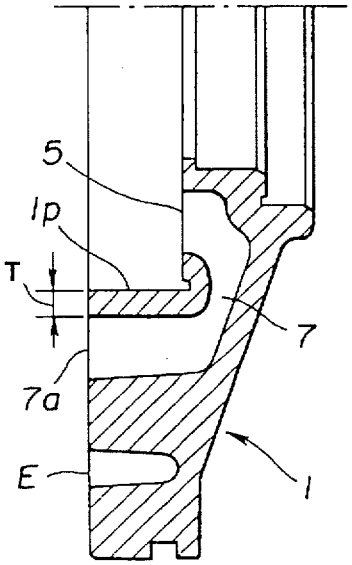
FIG. 4B is a view similar to FIG. 4A, taken along the line O-IVB in FIG. 3.
Figure 4C:
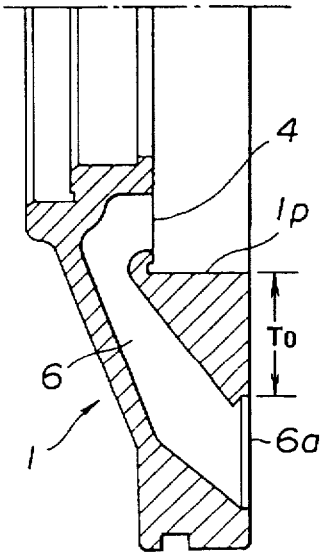
FIG. 4C is a view similar to FIG. 4B, taken along the line O-IVC in FIG. 3.

Referring to FIG. 4A, there is shown the discharge passage 7 including the reinforcing member H arranged to reinforce a wall T between the inner peripheral surface of the gear pocket 1*p* and the opening 7*a* of the discharge passage 7, the opening 7*a* facing in the rotational axis direction, the reinforcing member H extending in the rotational axis direction and being integrated with a portion that defines the opening 7*a* of the discharge passage 7 communicating with the discharge port 5. Referring to FIG. 4B, there is shown the discharge passage 7, which ensures communication of the discharge port 5 with the opening 7*a* of the discharge passage 7. Referring to FIG. 4C, there is shown a suction passage 6, which ensures communication of the suction port 4 with an opening of the suction passage 6. No reinforcing member is arranged to a wall To between the inner peripheral surface of the gear pocket 1*p* and the opening 6*a* of the suction passage 6.

Figure 5:
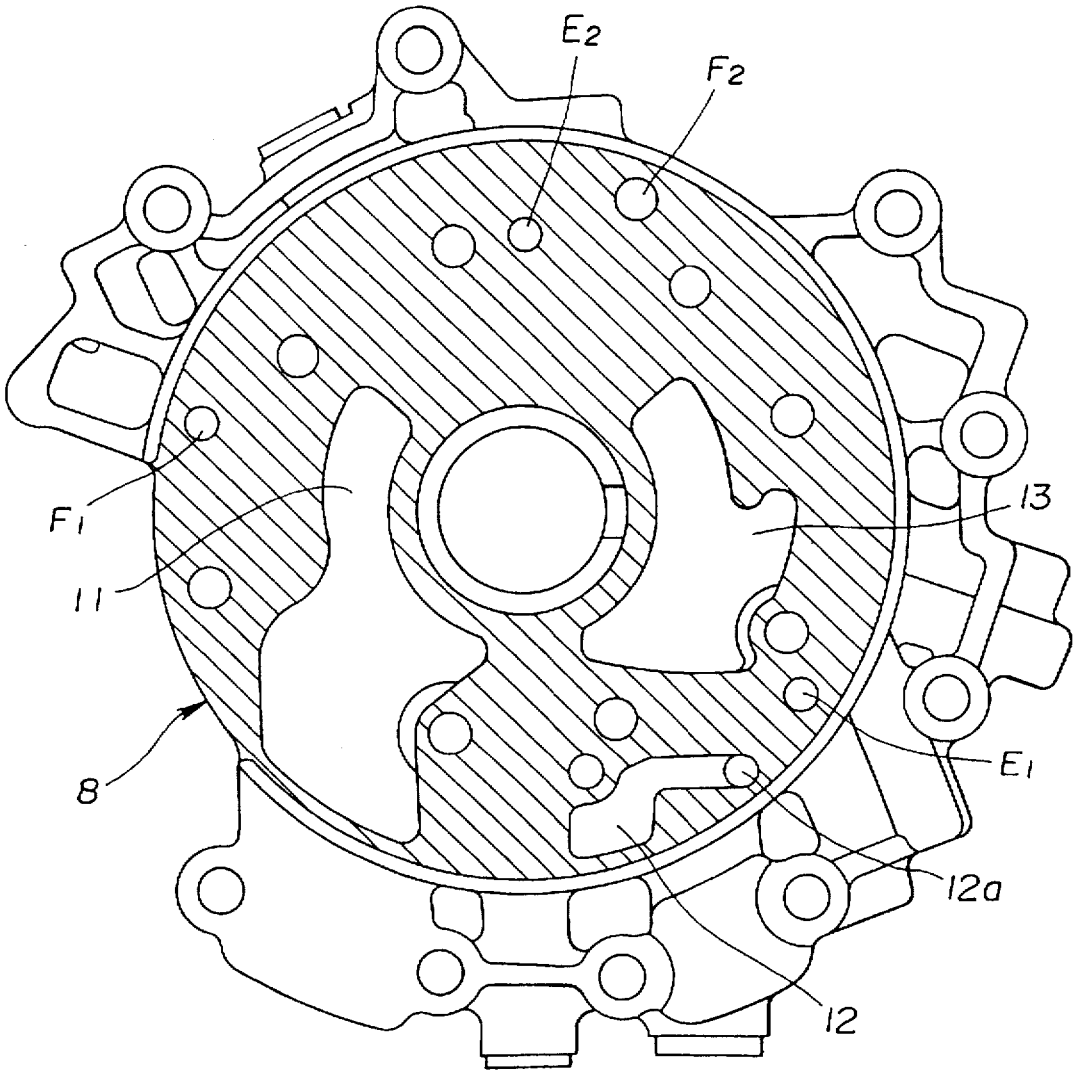
FIG. 5 is a view similar to FIG. 3, showing the pump cover as viewed from the mating face with the pump housing.

Referring to FIG. 5, a hydraulic chamber 11 is arranged to ensure communication of the suction port 4 of the pump housing 1 with the opening 6*a* of the suction passage 6, whereas a hydraulic chamber 12 having an opening 12*a* on the side of a flow control valve is arranged to communicate with the hydraulic chamber 11 through a hydraulic passage formed in the pump housing 1. Moreover, a hydraulic chamber 13 is arranged to ensure communication of the discharge port 5 with the opening 7*a* of the discharge passage 7. A reference numeral El designates an opening on the side of a lockup control valve, and E2 designates an opening on the side of the torque converter, both communicating with each other through the hydraulic passage E of the pump housing 1. A reference numeral F1 designates an opening on the side of lubrication, and F2 designates an opening on the side of a cooler, both communicating with each other through the hydraulic passage F of the pump housing 1.

Referring to FIGS. 3 to 4C, an operation of this embodiment will be described. When the outer gear 2 is rotated counterclockwise as viewed in FIG. 3 together with the inner gear 3, oil is sucked from the suction port 4 through the opening 6*a* of the suction passage 6 as shown in FIG. 4C. This oil has a volume increased in the pump chamber formed between the teeth of the outer and inner gears 2, 3 of the gear pocket 1*p*, then decreased therein with rotation, being discharged from the discharge port 5 to the opening 7*a* of the discharge passage 7 as shown in FIG. 4B so as to serve as working or lubricating fluid.

Since the reinforcing member H is arranged between the inner peripheral surface of the gear pocket 1*p* and the opening 7*a* of the discharge passage 7 to reinforce the wall T as shown in FIG. 4A, machining is possible, without any spring back to be produced when machining the inner peripheral surface of the gear pocket 1*p*, such that a clearance between an outer periphery of the outer gear 2 and an inner periphery of the gear pocket 1*p* is determined at some dozen μm with the circularity of some dozen μm, thus achieving a wide allowable range of the pressure of tens kg/cm$^2$ maximum at 6,000 rpm with regard to seizing.

Accordingly, since a reduction in a sectional area of the opening 7*a* of the discharge passage 7 is not needed as countermeasures against spring back, an amount of oil discharged from the discharge port 5 to the opening 7*a* of the discharge passage 7 is not increased excessively, resulting in no occurrence of seizing of the gears 2, 3. Moreover, if the reinforcing member H is arranged to a portion of the opening 6*a* of the suction passage 6, a pressure loss is reduced when oil is sucked from the opening 6*a* of the suction passage 6 to the suction port 4, resulting in difficult occurrence of cavitation noise.

Furthermore, two reinforcing members H may be arranged to both portions of the opening 6*a* of the suction passage 6 and the opening 7*a* of the discharge passage 7. In this embodiment, the present invention is applied to the gear-type pump, alternatively, it is applicable, for example, to a variable-volume-type vane pump having a space as limited as that of the gear-type pump, and constructed to suck oil by pump elements, which vary a volume of the pump chamber with rotation.

What is claimed is:

1. A pump comprising:

a housing having a cavity defining a pump chamber;

pump elements arranged in said cavity, said pump elements serving to vary a volume of said pump chamber, which is defined by said cavity and said pump elements, with rotation of said pump elements along a rotational axis;

a suction passage communicating with a suction port formed in an increased volume area of said pump chamber, said suction passage having an opening facing in the rotational axis direction;

a discharge passage communicating with a discharge port formed in a decreased volume area of said pump chamber, said discharge passage having an opening facing in the rotational axis direction;

a wall formed between an inner peripheral surface of said cavity and at least one of said openings of said suction passage and said discharge passage, means, arranged in said one opening, for reinforcing said wall, wherein said one opening has a first edge and a second edge substantially spaced apart in a radial direction from said first edge, said wall reinforcing means bridging said first edge, which is near said inner peripheral surface of said cavity, and said second edge, which is distant from said inner peripheral surface of said cavity, and extending in the rotational axis direction in said one opening to reinforce said wall.

2. A pump as claimed in claim 1, wherein said wall reinforcing means includes a reinforcing member.

3. A pump comprising:

a housing having a cavity defining a pump chamber;

pump elements arranged in said cavity, said pump elements serving to vary a volume of said pump chamber, which is defined by said cavity and said pump elements, with rotation of said pump elements along a rotational axis;

a suction passage communicating with a suction port formed in an increased volume area of said pump chamber, said suction passage having an opening facing in the rotational axis direction;

a discharge passage communicating with a discharge port formed in a decreased volume area of said pump chamber, said discharge passage having an opening facing in the rotational axis direction;

a wall formed between an inner peripheral surface of said cavity and at least one of said openings of said suction passage and said discharge passage; and a reinforcing members arranged in said one opening, for reinforcing said wall, wherein said one opening has a first edge and a second edge substantially spaced apart in a radial direction from said first edge, said reinforcing member bridging said first edge, which is near said inner peripheral surface of said cavity, and said second edge, which is distant from said inner peripheral surface of said cavity, and extending in the rotational axis direction in said one opening to reinforce said wall.

* * * * *